US006161400A

United States Patent [19]

Hummel

[11] Patent Number: 6,161,400

[45] Date of Patent: Dec. 19, 2000

[54] CUT-RESISTANT KNITTED FABRIC

[75] Inventor: Joseph Hummel, Amherst, Ohio

[73] Assignee: Whizard Protective Wear Corp., Birmingham, Ohio

[21] Appl. No.: 08/935,403

[22] Filed: Sep. 23, 1997

[51] Int. Cl.[7] ..... D04B 7/34

[52] U.S. Cl. ..... 66/174; 2/16

[58] Field of Search ..... 2/2.5, 16, 167; 66/169 R, 170, 171, 174, 196, 202; 442/307, 318

[56] References Cited

U.S. PATENT DOCUMENTS

| | | | |
|---|---|---|---|
| 2,942,442 | 6/1960 | Michael-Lohs | 66/174 |
| 4,470,251 | 9/1984 | Bettcher | 66/174 |
| 4,528,223 | 7/1985 | Kumazawa . | |
| 4,777,789 | 10/1988 | Kolmes et al. . | |
| 4,864,852 | 9/1989 | Boone . | |
| 4,912,781 | 4/1990 | Robins et al. | 2/16 |
| 5,119,512 | 6/1992 | Dunbar et al. . | |
| 5,321,960 | 6/1994 | Whit et al. | 66/202 |
| 5,597,649 | 1/1997 | Sandor et al. . | |
| 5,965,223 | 10/1999 | Andrews et al. | 66/202 |
| 5,976,998 | 11/1999 | Sandor et al. | 442/365 |

*Primary Examiner*—Danny Worrell
*Attorney, Agent, or Firm*—Watts, Hoffmann, Fisher & Heinke

[57] ABSTRACT

A cut-resistant fabric machine-knitted two-ends-in from two different yarns, one of which contains cut-resistant fiber and the other of which contains fibers having a hardness that tends to dull a cutting blade.

19 Claims, 2 Drawing Sheets

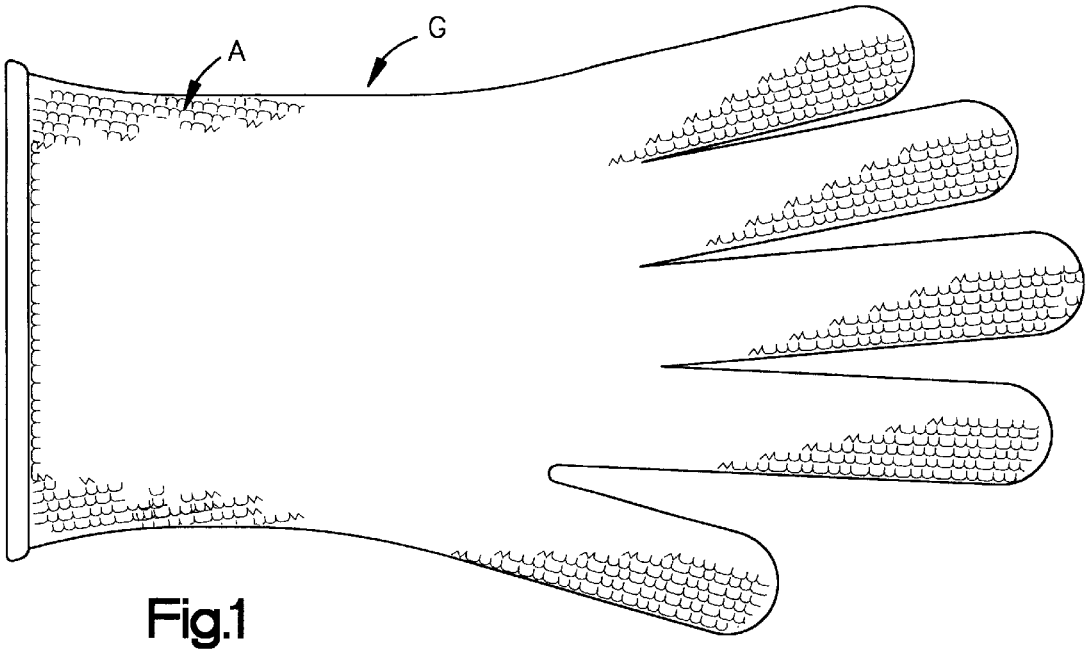
Fig.1
Fig.2
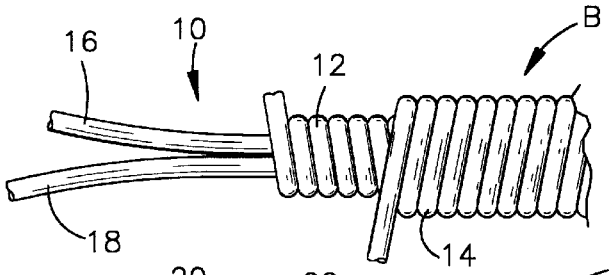
Fig.3
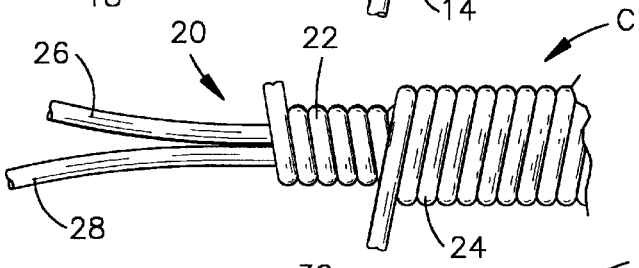
Fig.4
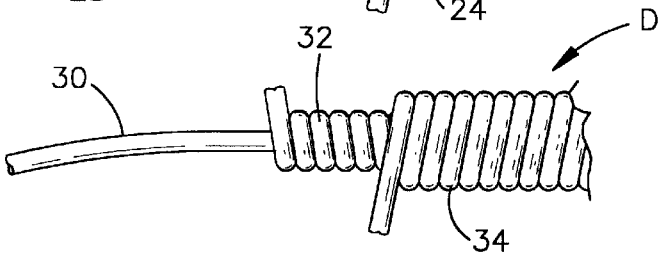
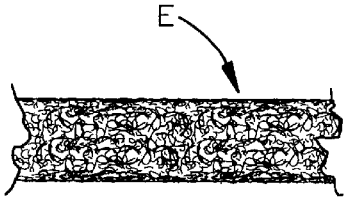
Fig.5
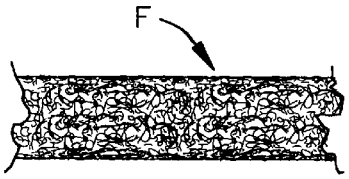
Fig.6

CUT-RESISTANT KNITTED FABRIC

BACKGROUND OF THE INVENTION

This invention relates to cut-resistant fabric machine-knitted two-ends-in from two different yarns, one of which contains cut-resistant fiber and the other of which contains fibers having a hardness that tends to dull a cutting blade.

Cut-resistant fabric made from yarn containing an inherently cut-resistant fiber and a fiber having a hardness above about 3 on the Mohs hardness scale is disclosed in U.S. Pat. No. 5,119,512. Cut-resistance is obtained by combining the two different materials in a single yarn, the hard material apparently dulling a cutting edge enough that the fabric is more resistant to the cutting than would be a fabric of yarn containing only the cut-resistant fiber. Such yarn has been proposed for forming cut-resistant garments, including gloves. Other cut-resistant gloves and yarns have also been proposed, as set forth in the aforementioned patent, including a testing procedure for determining cut-resistance. The disclosure of U.S. Pat. No. 5,119,512 is hereby incorporated herein by reference.

A cut-resistant yarn that utilizes a particle-filled fiber is disclosed in U.S. Pat. No. 5,597,649, the disclosure of which is hereby incorporated herein by reference. The particles are a hard material having a Mohs hardness value of greater than about 3, and the fiber is a high modulus cut-resistant fiber.

SUMMARY OF THE INVENTION

The present invention offers significant advantages over the use of the yarn of the aforementioned patents while utilizing a combination of an inherently cut-resistant fiber and a hard fiber or fiber containing hard particles to achieve high cut-resistance. These advantages are obtained by locating the two different types of fibers in separate yarns and knitting the yarns two-ends-in, i.e., both together, on a single knitting machine. This structure and process maintains the two different materials in close proximity so each can function concurrently in accordance with its specific property when the fabric so knitted is subjected to the cutting action of a sharp instrument, such as a knife. At the same time, the use of separate yarn strands having the different properties facilitates achieving a desired cut-resistance and fabric weight by conveniently allowing either yarn to be modified independently of the other. For example, depending upon the intended use of a fabric, one of the ends or yarn strands can be of lesser or greater denier for greater flexibility or greater cut-resistance without changing the other end, resulting in ease of manufacturing a variety of fabrics. In addition, one end, e.g., the end having the hard fiber, can be used with one of a variety of other yarns as the other end, having different weights (deniers) and/or utilizing different cut-resistant synthetic fibers that have different characteristics, such as abrasive resistance, heat tolerance, shrink-resistance, and chemical resistance, so optimum fabric construction for an intended purpose can be achieved with less inventory, to meet varying functional requirements and price constraints. Further, the two ends can be controlled in the knitting process to preferentially locate either of the ends at a selected surface of the fabric to emphasize the different characteristic of each end in a way to achieve maximum cut-resistance and/or increased comfort.

In its broader aspects, the present invention achieves these features and advantages by providing a cut-resistant fabric comprised of first and second separate ends of yarn machine-knitted together two-ends-in, the first of said ends comprised of a cut-resistant fiber and essentially free of any fiber having a hardness of greater than 3 Mohs on the hardness scale, and the second of said ends comprised of a fiber having a hardness of greater than 3 Mohs on the hardness scale. An example of a preferred fiber having a hardness of greater than 3 Mohs is ECG-150 fiber glass. In a preferred embodiment, the second of said ends is essentially free of any cut-resistant fiber.

The present invention also achieves these features and advantages through a process of concurrently knitting two yarns on a single knitting machine two-ends-in to form a protective cut-resistant fabric, one of the ends comprised of a cut-resistant fiber essentially free of any fiber having a hardness of greater than 3 Mohs on the hardness scale and the second of said ends comprised of a fiber having a hardness of greater than 3 Mohs.

The invention finds particular usefulness in the manufacture of cut-resistant protective gloves.

The process can advantageously include the step of plaiting the two ends of yarn during knitting to locate one of the ends predominantly at a first surface of a garment, and the other of the ends predominantly at a second surface of the garment. This allows placing of the typically more comfortable end predominantly on the inside of a garment and locating the other predominantly on the outside. Apart from comfort, the synthetic cut-resistant fiber end advantageously can be plated to the inside, such as the inside surface of a protective glove, and the hard fiber can be plaited predominantly to the outside, producing a garment in which the outer surface, which is most apt to first encounter any sharp edge, serves to effectively dull the edge before it encounters a majority of the cut-resistant fiber.

BRIEF DESCRIPTION OF THE DRAWINGS

FIG. 1 is a diagrammatic plan view of a protective glove knitted two ends-in, embodying the present invention;

FIG. 2 is a diagrammatic drawing of a composite yarn having two core strands and two wraps, the yarn containing cut-resistant fiber and free of hard fiber;

FIG. 3 is a diagrammatic drawing of a composite yarn having two core strands and two wraps, the yarn containing hard fiber and free of cut-resistant fiber;

FIG. 4 is a diagrammatic drawing of a composite yarn similar to the yarn of FIG. 2, but with a single core strand;

FIG. 5 is a diagrammatic drawing of a yarn formed of air-entangled fibers containing cut-resistant fiber and free of hard fiber;

FIG. 6 is a diagrammatic drawing of a yarn formed of air-entangled fibers containing hard fiber and free of cut-resistant fiber;

DESCRIPTION OF PREFERRED EMBODIMENTS

Figure 7:
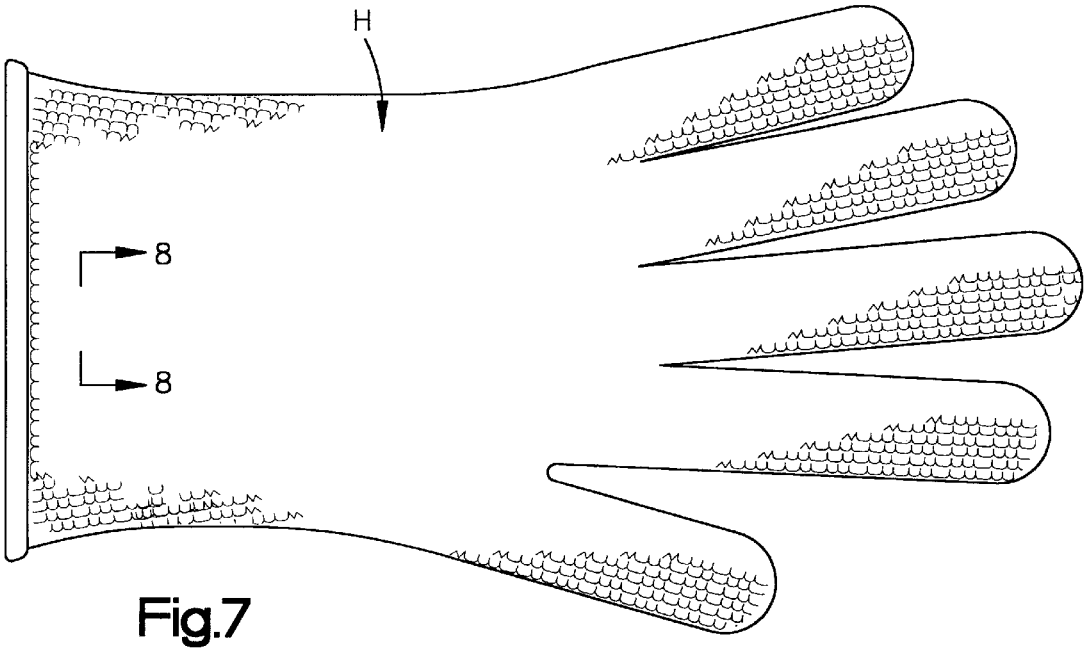
FIG. 7 is a diagrammatic plan view of a protective knit glove embodying the present invention in which two ends of yarn are plait-knitted.
Figure 8:
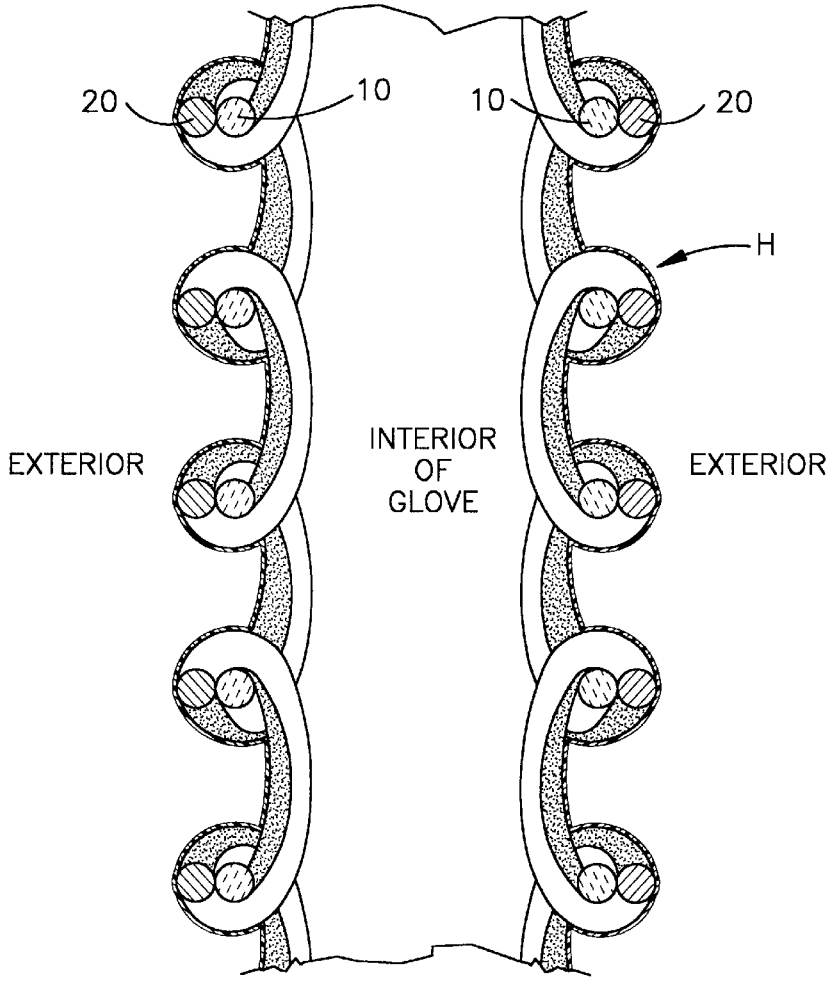
FIG. 8 is a diagrammatic sectional view taken along the line 8—8 of FIG. 7 and looking in the direction of the arrows, illustrating the location of one of the two ends predominantly at the exterior of the glove and the other predominantly at the interior.

With reference to the drawings, a preferred embodiment of the invention is a cut-resistant fabric A, shown in FIG. 1 in the form of a protective glove G, machine knit from two ends of yarn B, C (FIGS. 2 and 3). The glove finds particular use in the meat industry to protect workers' hands against injury from sharp implements, such as knives. The fabric in the form of a glove is advantageously knit on a 10 cut Shima knitting machine.

The yarn B is a composite yarn having a core 10, a first helical wrap 12 wound about the core and a second helical wrap 14 wound about the first wrap in an opposite direction from that of the wrap 12. The core 10 has two strands 16, 18 extending lengthwise of the yarn.

The yarn C is a composite yarn having a core 20, a first helical wrap 22 wound about the core and a second helical wrap 24 wound about the first wrap in an opposite direction from that of the wrap 22. The core 20 has two strands 26, 28 extending lengthwise of the yarn.

In one preferred embodiment of the invention, the yarn B contains cut-resistant fiber and is free of fiber having a hardness of above 3 Mohs on the hardness scale. The core strand 16 is a cut-resistant continuous-filament synthetic fiber of 400 denier high strength or normal strength thermotropic liquid crystalline polymer, such as Vectran HS or Vectran M, respectively. The core strand 18 is a cut-resistant continuous-filament synthetic fiber of 375 denier extended chain polyester such as Spectra, or alternatively 360 denier extended chain polyester such as Certran. The first and second wraps 12, 14 are each 70 denier nylon, wrapped eight turns per inch, with the turns of each wrap substantially touching one to the next to cover the core and preceding wrap.

The yarn C contains fiber having a hardness of above 3 Mohs on the hardness scale and is free of synthetic cut-resistant fiber. The core strand 26 is 220 denier normal strength polyester and the core strand 28 is 150 denier ECG-150 fiber glass. The first and second wraps 22, 24 are each 70 denier nylon, wrapped eight turns per inch, with the turns of each wrap substantially touching one to the next to cover the core and preceding wrap.

The two yarns B and C are together knitted two-ends-in, i.e., both yarns or ends are concurrently knitted by a common needle, on a 10-cut Shima knitting machine to produce a cut-resistant protective glove as shown at G in FIG. 1.

A second preferred embodiment is identical to the first, except that a yarn D (FIG. 4)containing cut-resistant fiber and free of fiber having a hardness above 3 Mohs on the hardness scale is substituted for the yarn B. The yarn D has a core 30 of a single strand of 400 denier high or normal strength thermotropic liquid crystalline polymer fiber, such as Vectran HS or M, respectively. The core is covered with first and second wraps 32, 34, each of 70 denier nylon wrapped eight turns per inch, with the turns of each wrap substantially touching one to the next to cover the core and preceding wrap.

A third preferred embodiment utilizes a first yarn E shown in FIG. 5 and a second yarn C as shown in FIG. 3 and described above. The yarn E is formed of air-entangled continuous length fibers. Air entanglement of continuous or staple length fibers is a known process for forming yarn from a multiplicity of individual fibers. The yarn E contains cut-resistant fibers and is free of fiber having a hardness of above 3 Mohs on the hardness scale. The cut-resistant fibers are continuous filament synthetic fibers of 400 denier high strength or normal strength thermotropic liquid crystalline polymer, such as Vectran HS or Vectran M, respectively. Additionally, the yarn E contains 220 denier normal strength polyester fibers. The proportion of high strength fibers to normal strength fibers being approximately 2:1 by weight. The yarns E and C are together knitted two-ends-in, i.e., both yarns or ends are concurrently knitted by a common needle, on a 10-cut Shima knitting machine to produce a cut-resistant protective glove as shown at G in FIG. 1.

A fourth preferred embodiment utilizes a first yarn E as described above and a second yarn F as shown in FIG. 6. The yarn F is formed of air-entangled continuous length fibers and includes fibers having a hardness of above 3 Mohs on the hardness scale and is free of cut-resistant synthetic fiber. The fibers are 220 denier normal strength polyester and 150 denier ECG-150 fiber glass in proportions of approximately 1:1 by weight.

The two yarns E and F are together knitted two-ends-in, i.e., both yarns or ends are concurrently knitted by a common needle, on a 10-cut Shima knitting machine to produce a cut-resistant protective glove G as shown in FIG. 1.

Cut-resistant fibers are considered to be those synthetic fibers that have a tenacity of above 10 grams per denier, and/or those synthetic fibers having a modulus greater than 200 grams per denier as measured by ASTM Test Method D-3822, and include aramid fibers such as Kevlar poly (p-phenyleneterephthalamide), high strength extended chain polyethylene fibers such as Spectra and Certran, high strength thermotropic liquid-crystalline polymer fibers such as Vectran HS, and polybenzazole-containing fibers such as fibers containing liquid-crystalline polybenzoxazole or polybenzothiazole polymer (PBO). They also include thermotropic liquid-crystalline polymer Vectran M fibers having a tenacity of 10 or below. Cut-resistant fibers are also those that have a cut-resistance equal to any of the above-mentioned cut-resistant fibers, as determined by any one of the following three industry accepted cut-tests:

(1) A slash test procedure that measurably simulates a knife under load contacting and moving across a fabric knitted from yarn. The slash test is performed to determine and record the load it takes to cut through the knitted fabric. A relatively higher "slash test load" is indicative of a relatively more cut-resistant fabric. A yarn of the fiber to be tested is knitted into a fabric sample that is then manipulated so it is substantially flat and placed into a test fixture constructed to stretch the fabric sample and load each yarn or thread in the fabric to about a five pound tensile load. The test fixture and fabric sample are placed in an Instron model 4465 test machine with the fabric sample oriented at a 45° angle relative to the direction that a sharpened test blade is to be moved.

The test blade is moved under load in a straight line against the fabric sample. The weight or load acting on the test blade against the fabric sample is variable. The test blade is carbide steel and has four sharpened and independent circumferentially spaced arcuate cutting sections. Each section of the test blade performs only one slash test. The test blade is removed and re-sharpened after all four sections perform a slash test. A test blade section is deemed "sharp" when a slash test load in the range of nine pounds to sixteen pounds causes the blade to cut through a standardized fabric using the above described procedure. The standardized fabric used is available from Whizard Protective Wear Corp. under the name Handguard II. The Handguard II fabric is machine knitted two-ends-in, five and one half needles per inch of a specific yarn of about 0.023 inch diameter. Each yarn has a core consisting of a multifilament strand of 375 denier Spectra 1000 fiber. Each yarn has oppositely wound helical wraps about the core. These wraps consist of, in the order set forth, a first and second wrap of a multifilament strand of 70 denier nylon fiber, six turns per inch each; a third wrap of one end of 0.0016 stainless steel, eight turns per inch; a fourth wrap of a multifilament strand of 400 denier Kevlar fiber, ten wraps per inch; a fifth wrap of multifilament strand of 650 denier Spectra 900 fiber, 10 wraps per inch; and a sixth wrap of a multifilament strand of 440 denier polyester fiber, 10 wraps per inch. To determine if a fiber is cut-resistant, a slash test is performed on a fabric knitted from a yarn of the fiber. The test blade, under a selected load, is brought into engagement with the fabric sample three times. Each time, a new cutting section of the test blade is used and the blade engages a different portion of the fabric at a different orientation relative to a knit loop. The three test orientations are directly across a knit loop, directly along a knit loop, and diagonally across a knit loop. The loads sufficient for the test blade to cut through each fabric sample in the three test directions are recorded and averaged. Each average slash value is an average of 25 readings. The average load in pounds required to cut completely through the fabric sample may be referred to as the "slash test load."

(2) A procedure known as the Ashland Cut Protection Performance Test (CPPT) for determining if a fiber or yarn is cut-resistant, which is disclosed in U.S. Pat. No. 5,597,649, the disclosure of which has been incorporated herein by reference. In the Ashland test procedure, a fabric sample of the yarn to be tested is placed on the convex surface of a mandrel. A series of tests is carried out in which a razor blade loaded with a variable weight is pulled across the fabric until the fabric at the location of contact is cut all the way through. The distance the razor blade travels across the the location of contact with the fabric, until the blade cuts completely through the fabric, is measured. The logarithm of the distance of blade travel required to make the cut is plotted on a graph as a function of the load on the razor blade. The data are collected and plotted for cut distances varying from 0.3 inch to about 1.8 inches. The resulting plot is approximately a straight line. An idealized straight line is drawn or calculated through the points on the plot, and the weight required to cut through the cloth after one inch of travel across the fabric is taken from the plot or calculated by regression analysis. This is referred to as the "CPP" value. By forming the fabric of a fiber to be tested, a value indicative of the cut-resistance of the fiber is determined.

(3) A Betatec impact cam test for determining if a fiber or yarn is cut-resistant, which is disclosed in U.S. Pat. No. 5,597,649, the disclosure of which has been incorporated herein by reference. The method and apparatus are described in U.S. Pat. No. 4,864,852, the disclosure of which is hereby incorporated by reference. The determination involves repeatedly contacting a sample with a sharp edge that falls on the sample, which is rotating on a mandrel. These contacts are repeated until the sample is penetrated by the cutting edge. The greater the number of cutting cycles (contacts) required to penetrate the sample, the greater the cut resistance of the sample. By way of example, the following conditions can be used: 180 grams cutting weight, a mandrel speed of 50 rpm, a rotating steel mandrel diameter of 19 mm, a cutting blade drop height of about ¾ inch, use of a single edged industrial razor blade for cutting, a cutting arm distance from pivot point to center of blade about 15.2 cm (about 6 inches).

While preferred embodiments have been described in detail, modifications or alterations may be made without departing from the invention. Thus, any of the above-mentioned cut-resistant fibers or fibers of equivalent cut-resistance or mixtures thereof may be substituted for those of the preferred embodiments, as may other hard fibers, such as ceramic or carbon fiber or particle-filled fibers containing hard fillers, or mixtures thereof, be substituted for the fiber glass of the preferred embodiments. Particle-filled fibers containing hard fillers are described in U.S. Pat. No. 5,597,649. Also, depending upon the cut-resistance required and the flexibility of the garment, especially the flexibility and feel required of a glove, deniers of the fibers may vary from those set forth above in the preferred embodiments. For example, in the cut-resistant end of yarn, the total denier of the cut-resistant fiber may vary between 300 and 800, and the denier of the hard fibers in the other yarn may vary between 75 and 500, in the manufacture of knitted protective gloves suitable for industrial uses such as in the food industry and particularly in the meat packing industry. Non-cut-resistant fibers other than the nylon and polyester of the preferred embodiments may be used, including natural fibers, along with the cut-resistant and hard fibers, to provide desired bulk and softness. The deniers of those fibers will vary, depending upon the bulk desired.

To assure knittability and good cut-resistance using two-ends-in on conventional glove-knitting machines, the overall diameter of each end of yarn is preferably from about 0.003 to 0.026 inch. It is desirable, although not essential, that each end be of about the same diameter. The total of the two diameters individually measured should not exceed 0.052 inch. This provides slightly greater mass than could be knit if used to form a single yarn, the maximum diameter of a machine-knittable single yarn being about 0.035 inch. This is because the two ends are movable relative to each other during knitting and therefore can be knitted through the finger crotches more easily than a single yarn of equivalent mass. The knitting can be done on a 5-cut, 10-cut, 13-cut, or 15-cut knitting machine.

While the covering wraps of the composite yarns of the preferred embodiments are wound eight turns per inch, this can vary from 2 to 16. It is desirable to use sufficient wraps and turns per wrap to completely cover the core of a composite yarn.

The preferred yarns are free of metallic fiber, such as stainless steel wire, although additional cut-resistance can be obtained by its inclusion as either a core strand or a wrap, or its incorporation into the entangled yarns, but at the cost of increased yarn stiffness.

What is claimed is:

1. A cut-resistant fabric comprising first and second separate ends of yarn machine-knitted together two-ends-in, the first of said ends comprised of a cut-resistant fiber and essentially free of any fiber having a hardness of greater than 3 Mohs on the hardness scale and the second of said ends comprised of a fiber having a hardness of greater than 3 Mohs on the hardness scale.

2. A fabric as set forth in claim 1 wherein the cut-resistant fiber of said first end has a denier of between 300 and 800 and the hard fiber of said second end has a denier of between 75 and 500.

3. A fabric as set forth in claim 1 wherein each end is a composite yarn having a core and covering.

4. A fabric as set forth in claim 3 wherein both coverings of the composite yarns include a non-cut-resistant fiber.

5. A fabric as set forth in claim 3 wherein the cut-resistant fiber of the first end and the fiber having a hardness of greater than 3 Mohs of the second end are present in the cores of the respective ends.

6. A fabric as set forth in claim 3 wherein the covering of one end is comprised of two fiber wrappings oppositely wound.

7. A fabric as set forth in claim 1 wherein the cut-resistant fiber is selected from the group consisting of synthetic fibers having a tenacity of at least 10 grams per denier, synthetic fibers having a stiffness modulus of at least 200 grams per denier, fibers of thermotropic liquid-crystalline polymer, fibers of extended chain polyethylene, fibers containing polybenzazole polymer, and aramid fibers.

8. A fabric as set forth in claim 7 wherein the aramid fibers are poly (p-phenyleneterephthalamide).

9. A fabric as set forth in claim 1 wherein the fibers having a hardness of greater than 3 Mohs are selected from the group consisting of glass, ceramic and carbon, and synthetic fibers having one or more hard particulate fillers.

10. A fabric as set forth in claim 1 wherein one of the separate ends is comprised of entangled fibers.

11. A fabric as set forth in claim 10 wherein each end includes a fiber that is not cut-resistant.

12. A fabric as set forth in claim 1 wherein both of the separate ends are comprised of entangled fibers.

13. A fabric as set forth in any one of claims 1–12 wherein the second end is free of any cut-resistant fiber.

14. A fabric as set forth in any one of claims 1–12 wherein the fabric is plaited, with one end of yarn predominantly on one side of the fabric and the other end predominantly on an opposite side of the fabric.

15. A fabric as set forth in any one of claims 1–12 wherein the fabric is in the form of a glove.

16. In a method of making a cut-resistant fabric, the steps comprising concurrently knitting on a single knitting machine two-ends-in to form a protective cut-resistant fabric, one of said ends comprised of a cut-resistant fiber and essentially free of any fiber having a hardness of greater than 3 Mohs on the hardness scale and the second of said ends comprised of a fiber having a hardness of greater than 3 Mohs.

17. In a method of making a cut-resistant protective glove, the steps comprising concurrently knitting on a single knitting machine two-ends-in of different yarn to form a glove, the one of said ends comprised of a cut-resistant fiber and essentially free of any fiber having a hardness of greater than 3 Mohs on the hardness scale and the second of said ends comprised of a fiber having a hardness of greater than 3 Mohs.

18. A method as set forth in claim 16 or 17 including the step of plaiting the two ends of yarn during knitting to locate one of the ends predominantly at a first surface of the fabric and the other of the ends predominantly at a second surface of the fabric.

19. A method as set forth in claim 16 or 17 wherein the second of said ends is essentially free of any cut-resistant fiber.

* * * * *